United States Patent [19]

Anderson

[11] 3,988,186

[45] Oct. 26, 1976

[54] AEROSOL SAFETY CAP PERMANENTLY WELDED TO CONTAINER

[75] Inventor: Victor F. Anderson, Wenonah, N.J.

[73] Assignee: Shell Oil Company, Houston, Tex.

[22] Filed: Sept. 23, 1974

[21] Appl. No.: 508,365

[52] U.S. Cl. ..... 156/69; 156/73.1; 156/294

[51] Int. Cl.[2] ..... B29C 27/02

[58] Field of Search.... 222/153, 182, 402.1–402.13; 220/317, 320, 359, 306; 215/246; 156/69, 294, 73.1

[56] References Cited

UNITED STATES PATENTS 3,223,287 12/1965 Sagarin ..... 222/402.13

*Primary Examiner*—Robert B. Reeves
*Assistant Examiner*—John P. Shannon

[57] ABSTRACT

A child proof aerosol package in which the safety cap is permanently welded to the aerosol container.

1 Claim, 5 Drawing Figures

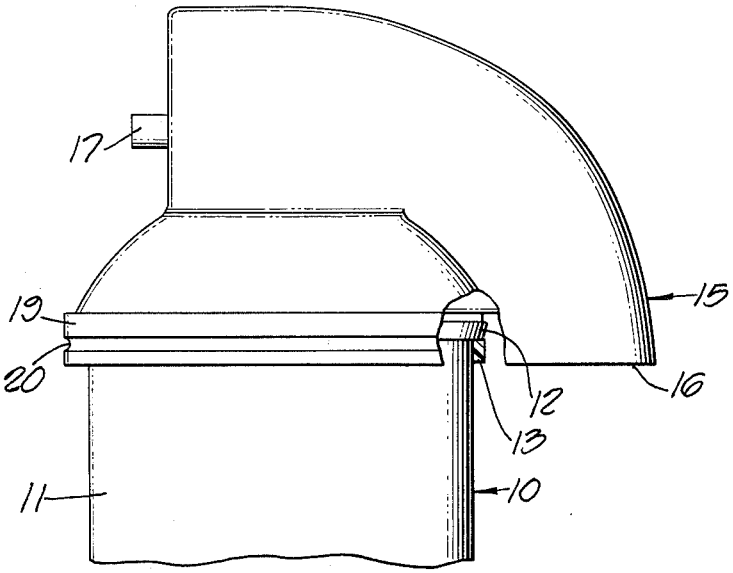
FIG. 1.
FIG. 2.
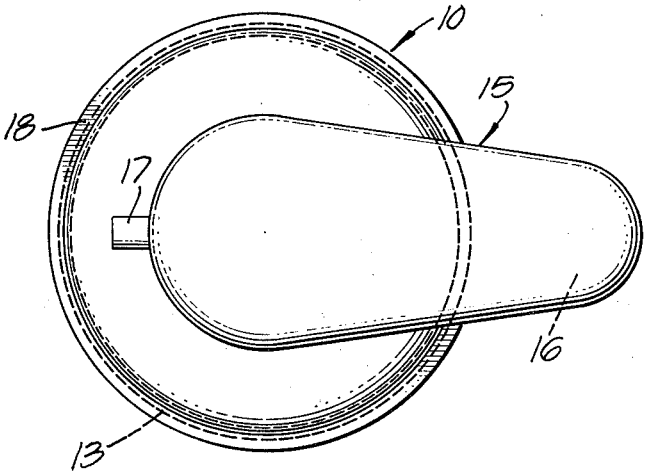
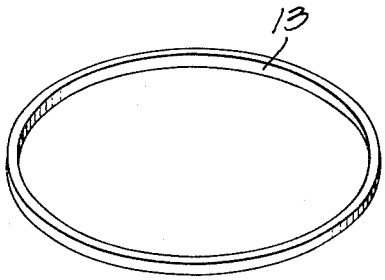
FIG. 5.
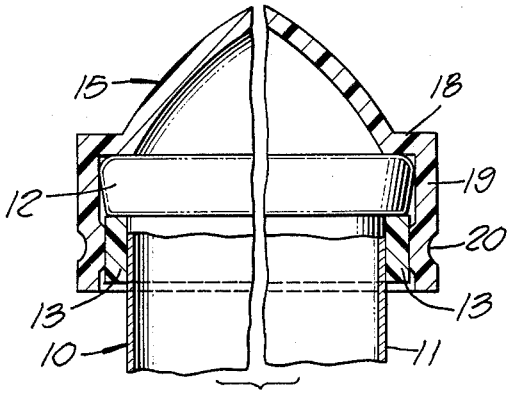
FIG. 4.
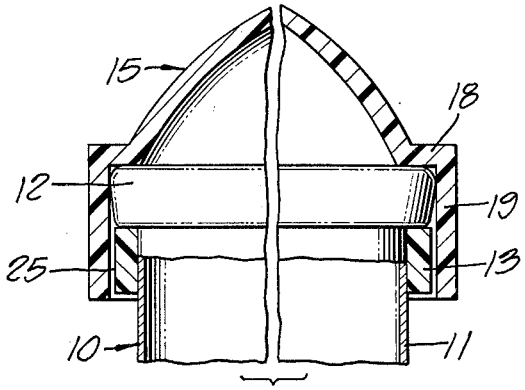
FIG. 3.

AEROSOL SAFETY CAP PERMANENTLY WELDED TO CONTAINER

BACKGROUND OF THE INVENTION

A method of making aerosol containers safe against accidental opening by small children has been to provide a safety cap covering the dispensing valve mechanism, which safety cap permits entry by the finger of an adult person for purpose of actuating the valve mechanism but which cannot successfully be entered by the finger of a very small child. Safety containers of this type are shown, for example, in the Corll U.S. Pat. No. 3,712,515.

It is essential in such a device, however, that either the safety cap be permanently secured to the container, or else the removal of the safety cap will result in removing the actuating valve mechanism as well.

Since products of this type are produced on a large volume basis, and it is inherently desirable to keep the cost of production low, there are severe limitations as to the cost of the materials that may be used and there are also severe limitations with regard to the dimensional tolerances of the various parts of the device that can be successfully achieved in the manufacturing operation. A commercially successful container, therefore, requires structural integrity that can be achieved within the available limitations of cost and dimensional tolerances.

SUMMARY OF THE INVENTION

According to the present invention a safety cap made of plastic material is supported from a ring also made of plastic material, but the cap and the ring are initially manufactured as separate parts. The ring is placed about the exterior surface of the cylindrical metal container for the aerosol product. The ring is retained in place by the circumferential bead formed on the upper rim of the container. The plastic safety cap is then placed over the upper end of the container including its associated dispensing valve mechanism, so that the lower portion of the safety cap extends about the bead and the ring. The lower periphery of the safety cap is then welded to the ring in order to permanently secure the safety cap on the container.

DRAWING SUMMARY

FIG. 1 is an elevation view, partially in cross-section, of the presently preferred form of the invention;

FIG. 2 is a top plan view of the invention;

FIG. 3 is an elevational view, partially in cross-section, showing the safety cap assembled to the container;

FIG. 4 is a view like FIG. 3 but showing the safety cap welded to the ring; and FIG. 5 is a perspective view of the ring.

PREFERRED EMBODIMENT

Referring now to the drawings, an aerosol package 10 includes a cylindrical metal container 11 having a circumferential bead 12 formed on its upper end. A plastic safety cap 15 extends above the upper end of container 10 and provides a hooded opening 16 on one side of the container into which an adult person can insert one finger for the purpose of reaching and actuating the dispensing valve mechanism that is contained within the safety cap but not specifically shown in the present drawing. Liquid material is then dispensed from a nozzle 17, located above the container 10 and at the opposite side of safety cap 15, which nozzle is associated with the dispensing valve mechanism.

A plastic ring 13 is made of such size as to fit tightly about the exterior circumference of the container 11. In the manufacturing process the plastic ring 13 is placed about the container 11 either by passing it upward over the lower end of the container, or else by passing it downward over the upper end of the container before the bead 12 is formed. Plastic ring 13 is then firmly lodged against the under side of bead 12 and in relatively tight engagement with the exterior surface of container 11. Ring 13 may be the upper end of a cylindrical outer housing for container 11.

The safety cap 15 includes a base portion that is adapted to fit over the upper end of container 11, and this base portion includes a small horizontally outwardly extending circumferential flange 18 from whose peripherial edge a cylindrical flange 19 depends downwardly. See FIG. 3. When safety cap 15 is positioned upon container 11 as shown in FIG. 3 the underside of flange 18 rests upon the upper horizontal surface of bead 12, while the vertical or cylindrical flange 19 extends about the bead 12 and also about the plastic ring 13.

The next step in the manufacturing process is to weld the flange 19 to the ring 13. The welding may be accomplished by means of a solvent, or by means of the application of ultrasonic energy, or by heat induction. Flange 19 is welded around its entire circumference to the entire circumference of ring 13, and this may result in a groove or depression 20 appearing on the exterior surface of the flange 19.

When the product has been assembled in accordance with the present invention it then becomes impossible to remove the safety cap 15 from the container 11. Yet the manufacturing process is achieved without any high precision requirements. Prior to welding there is a radial or annular space 25 between the flange 19 and the ring 13, as shown in FIG. 3. The exact radial dimension of this space may vary considerably depending upon the manufacturing tolerances of the various parts. However, the safety cap 15 and particularly the vertical flange 19 thereof is characterized by considerable resiliency, and when the welding operation is performed the material of the flange 19 is drawn inwardly against and into direct contact with the material of the ring 13 thereby providing a positive securement or lock mechanism.

The invention has been described in considerable detail in order to comply with the patent laws by providing a full public disclosure of at least one of its forms. However, such detailed description is not intended in any way to limit the broad features or principles of the invention, or the scope of patent to be granted.

What is claimed is:

1. The method of permanently securing a plastic safety cap upon the upper end of a cylindrical metal aerosol container having a circumferential bead thereon, which consists in placing a continuous plastic ring in tight engagement with the exterior surface of said container immediately beneath said bead, placing said plastic safety cap about said container so as to extend around and about both said bead and said ring, and thereafter welding the adjacent portion of said safety cap to said ring.

* * * * *